US005785262A

United States Patent [19]

Tippett

[11] Patent Number: 5,785,262

[45] Date of Patent: Jul. 28, 1998

[54] APPARATUS FPR DISPERSING FINELY DIVIDED SOLID PARTICLES IN A LIQUID VEHICLE

[76] Inventor: Jerome P. Tippett, 745 Pinellas Bayway #102, Tierra Verde, Fla. 33715

[21] Appl. No.: 816,548

[22] Filed: Mar. 13, 1997

[51] Int. Cl.[6] ..... B02C 17/16

[52] U.S. Cl. ..... 241/74; 241/171; 241/172

[58] Field of Search ..... 241/74, 170, 171, 241/172, 46.17

[56] References Cited

U.S. PATENT DOCUMENTS

| | | | |
|---|---|---|---|
| 3,844,490 | 10/1974 | Schold et al. | 241/74 |
| 4,394,981 | 7/1983 | Schold | 241/46.17 |
| 4,651,935 | 3/1987 | Samosky et al. | 241/65 |
| 4,742,966 | 5/1988 | Szkaradek et al. | 241/69 |
| 5,114,080 | 5/1992 | Pujol | 241/69 |
| 5,474,237 | 12/1995 | Bishop et al. | 241/21 |

*Primary Examiner*—John M. Husar
*Attorney, Agent, or Firm*—Frank R. Thienpont

[57] ABSTRACT

Apparatus for dispersing solid particles in a liquid vehicle utilizing a rotor separator mounted on an agitating shaft for rotation therewith, the rotor separator including one or more filter assemblies each of which comprises a plurality of axially spaced ring discs concentrically disposed about the agitator shaft and disposed between two or more agitator discs, the ring discs being spaced apart a predetermined distance to function as a filter to separate dispersing media from the product being processed.

11 Claims, 2 Drawing Sheets

APPARATUS FPR DISPERSING FINELY DIVIDED SOLID PARTICLES IN A LIQUID VEHICLE

BACKGROUND OF THE INVENTION

This invention relates to apparatus for uniformly producing finely divided particles and uniformly distributing such finely divided particles in a liquid vehicle.

The invention herein constitutes an improvement to apparatus of the type disclosed in U.S. Pat. No. 3,653,600 issued Apr. 4, 1972, U.S. Pat. No. 3,844,490 issued Oct. 29, 1974, and U.S. Pat. No. 4,394,981 issued Jul. 26, 1983. Units of this type are regularly made in which the mixing vessels have capacities from ½ gallon to as much as 150 gallons or more. These are enclosed units which operate under pressure and which rely upon pressure to move the processed product through the mill and to the outlet through a rotor separator which incorporates a filtering mechanism as part of the rotor separator construction. The combination of the dispersing media, being used, such as steel shot, for example, and the pressure generated within the mixing vessel cause the dispersing media to congregate in the vicinity of the rotor separator and its attached filtering screen which are usually positioned in close proximity to the outlet from the vessel. This also tends to cause substantial wear on the rotor separator necessitating frequent renewal of the filtering mechanism. It is important to prevent clogging of whatever filtering means is used and to reduce wear as much as possible. Continuing efforts are made to reduce as much as possible clogging of the filtering means associated with the rotor separator and also to devise improved mechanisms which are less subject to wear.

Accordingly, it has become appropriate to develop a new and improved filter mechanism which is more durable, less subject to wear and generally lasts longer than prior mechanisms and tend to reduce the tendency of the dispersing media to congregate in the vicinity of the rotor separator.

SUMMARY OF THE INVENTION

A principal object of the invention is to provide an improved rotor separator which will permit easier and faster throughput of processed product.

Another object of the invention is to provide an improved filter assembly to be used with the rotor separator which will keep clogging in the vicinity of the rotor separator to a minimum.

A further object of the invention is to provide a rotor separator which is very durable and has a longer wear life than prior art structures.

It is another object of the invention to provide a filter assembly as part of the rotor separator which comprises a stack of spaced metal discs disposed between and attached to adjacent agitator discs which will allow processed product to pass from an associated mill chamber through the stack of discs and to the mill outlet.

A further object of the invention is to provide a rotor separator which has substantial flexibility in that the design of the filter assembly allows for easy changing of spacers and discs as to number and size to accommodate the type of raw material being processed and/or desired characteristics of the final product.

Other objects and advantages of this invention will become more apparent when considering the following description and accompanying drawings.

DESCRIPTION OF PREFERRED EMBODIMENT

Figure 1:
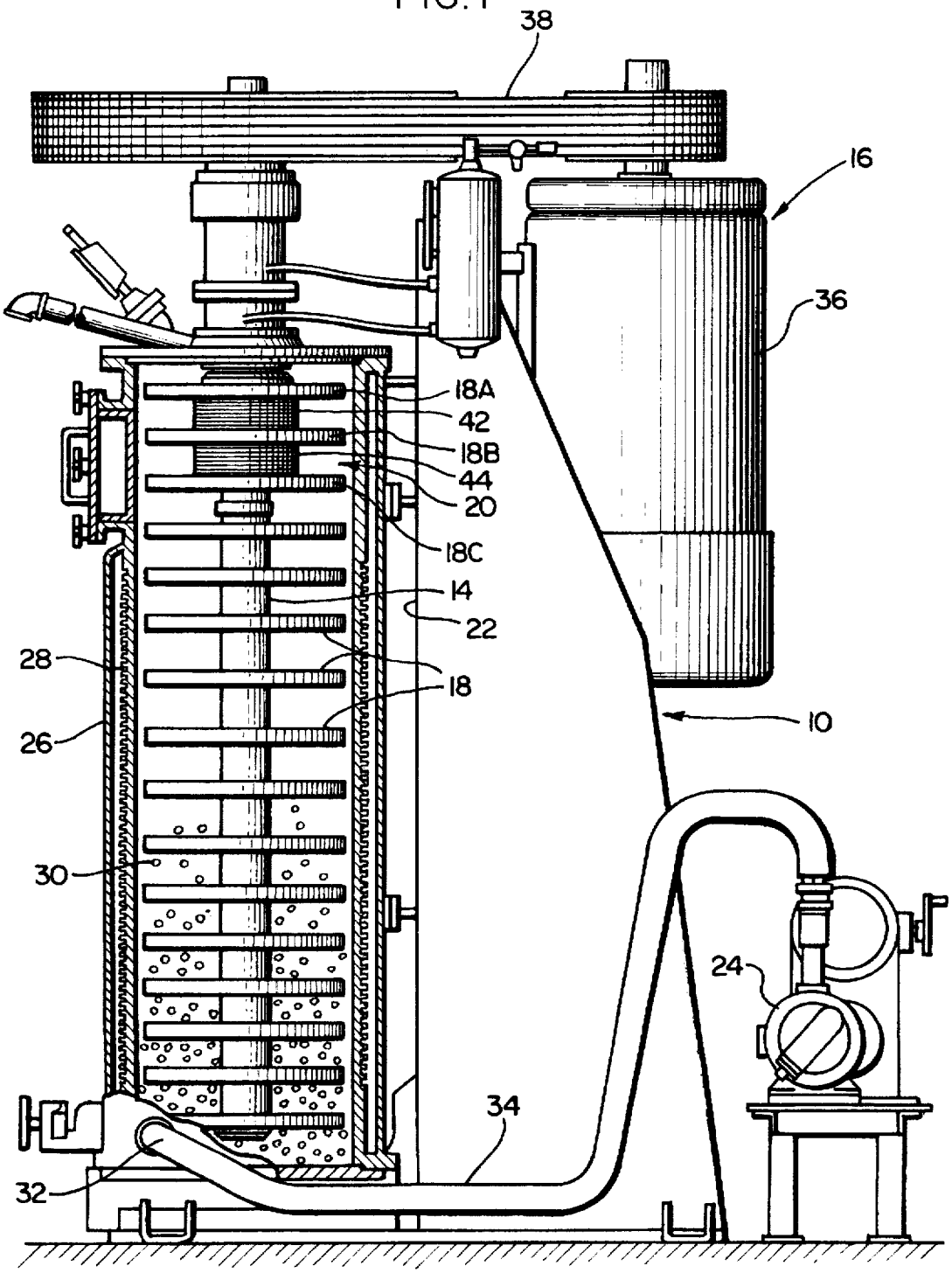
FIG. 1 is a cutaway sectional view in elevation of apparatus embodying the present invention.
Figure 2:
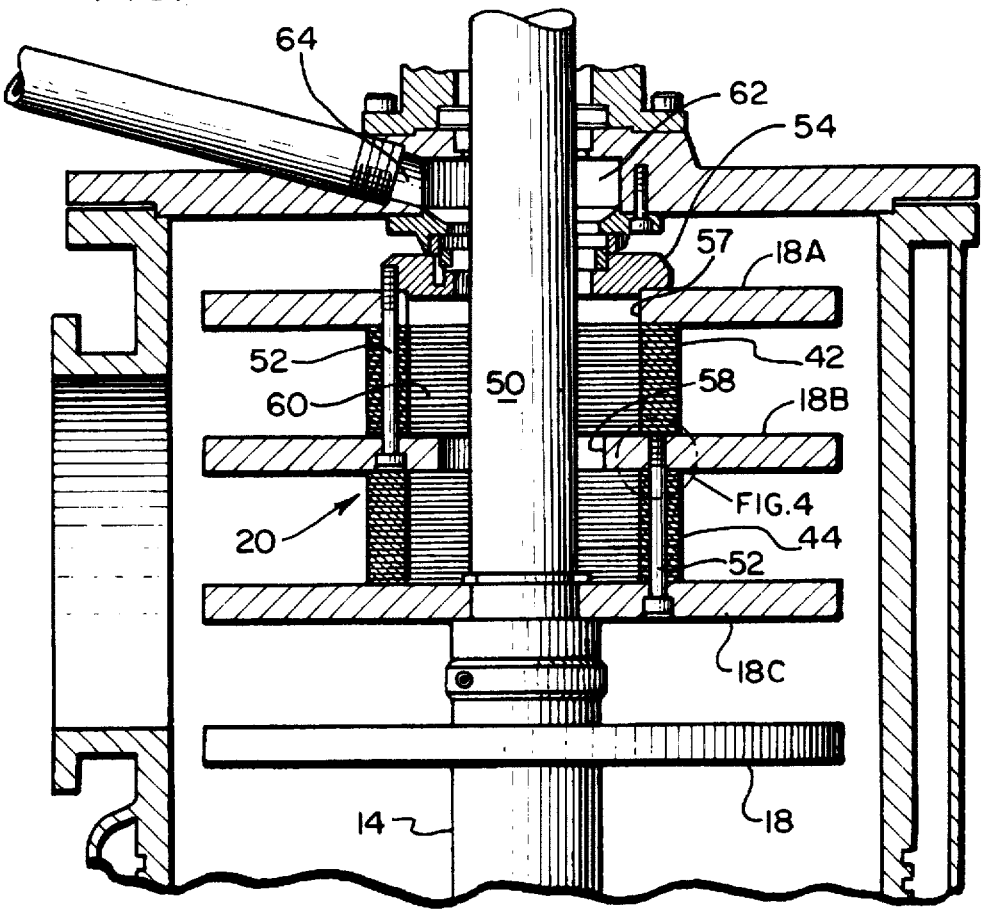
FIG. 2 is an enlarged cutaway sectional view in elevation of the upper portion of the mixing vessel shown in FIG. 1.
Figure 3:
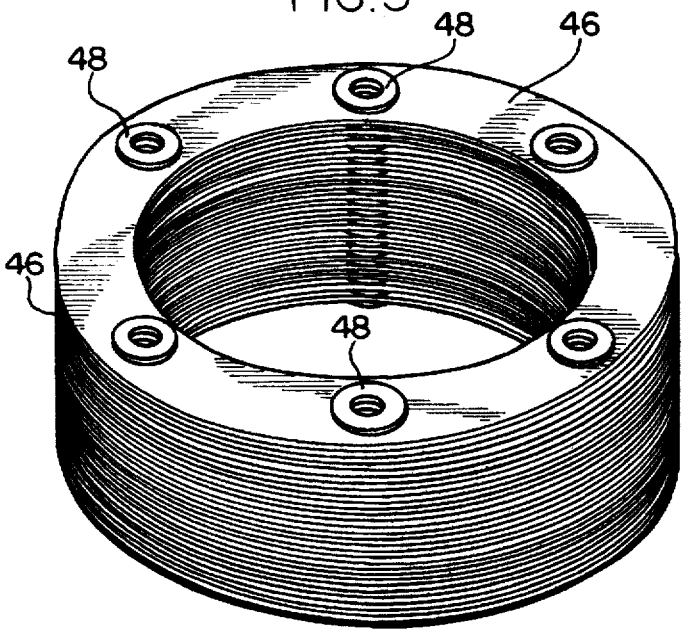
FIG. 3 is an enlarged perspective view of a stack of ring discs and spacers as used in the filter assemblies shown in FIG. 2.

We refer now to the drawings wherein like reference characters in the several views designate similar parts. Referring to FIG. 1, 10 designates generally the dispersing apparatus or mill embodying the invention herein. The dispersing apparatus 10 which is of the same general type as that disclosed in the aforementioned U.S. Patents comprises a generally cylindrical vessel 12, a rotatable agitator shaft 14, a drive unit 16 for driving the shaft 14, a plurality of impeller or agitator discs 18 mounted on the shaft 14 and a rotor separator 20 secured to the shaft 14. The vessel 10 and drive unit 16 usually are mounted on a suitable supporting frame 22. A pump 24 is associated with the mill to introduce pre-mixed material into the vessel 12 to be processed. A circumferentially extending jacket 26 is radially spaced from the vessel 12 to form therewith a chamber 28 through which a temperature controlling fluid may be circulated by means of inlet and outlet connections (not shown) but usually disposed at the upper and lower parts of the chamber 28 as is well known in the art.

The vessel is partially filled with a dispersing media 30 such as steel shot, for example, but other dispersing media can be used. When steel shot is used the vessel preferably is filled only about half way.

In the illustrated embodiment the vessel 12 is closed at both its upper and lower ends. An inlet 32 is formed in the lower end of the vessel through which a product to be processed is pumped from pump 24 via conduit 34. An outlet is disposed at the upper end of the vessel.

The drive unit 16 may include a variable speed motor 36 drivingly connected to shaft 14 by a belt and pulley arrangement 38 and an adjustable control for varying the tension on the belt and pulley arrangement to provide additional shaft speed control.

The rotor separator 20 which separates the dispersing media from the finished product comprises three annular rotor separator agitator discs 18A, 18B and 18C and two filter assemblies 42 and 44 disposed between discs 18A and 18B and between discs 18B and 18C respectively. The lowermost agitator disc 18C is keyed to shaft extension 50. While in the illustrated embodiment, the rotor separator 20 is shown as comprising two filter assemblies 42 and 44 it should be understood that the number of filter assemblies may vary—it may be as few as one or even as many as three or more depending on a number of factors such as the product being processed, the viscosity of the mixture, etc.

Figure 4:
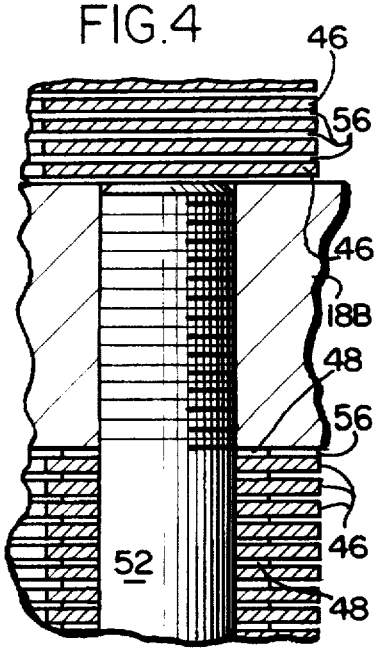
FIG. 4 is an enlarged view of the circled portion of FIG. 2 showing a connection of one of the bolts to an agitator disc, securing discs and spacers in place between two adjacent agitator discs.

Because the filter assemblies 42 and 44 are of the same type, only one will be described in detail. Filter assembly 42 comprises a plurality of stacked flat metallic ring discs 46 spaced apart by a plurality of spacers 48. The discs 46, which preferably are made of stainless steel, are disposed between the two adjacent rotor separator agitator discs 18A and 18B and concentrically about the shaft extension 50 of shaft 14. The ring discs 46 are held in place in their concentric relationship with the shaft extension 50 by a plurality of bolts 52 (six per filter assembly as herein disclosed) which extend through agitator disc 18B, through the ring discs 46 and spacers 48 disposed between adjacent ring discs 46, then through the next adjacent agitator disc 18A and into collar 54. While the ring discs may be spaced from each other by various means, as herein disclosed the ring discs 46 are spaced from each other by washer-like spacers 48 which are mounted on each of the bolts 52 between adjacent discs 46 as best seen in the enlarged view of FIG. 4. These spacers 48 also preferrably are made of stainless steel. Thus, there is created between adjacent ring discs, spaces 56 which are the size of the thickness of a spacer. In the embodiment shown in the drawings, six bolts 52 are used in each filter assembly 42 and 44 to secure a set of ring discs 46 between two adjacent agitator discs.

The size of the spaces 56 between adjacent discs may be varied by using spacers of different thicknesses. The space between adjacent discs may be varied to process different kinds of materials, to accommodate different viscosities and to achieve varying degrees of fineness in the finished product. While it is contemplated that spacers of a thickness between 0.010 and 0.030 of an inch can be used, it has been found that a spacer thickness of approximately 0.020 of an inch is appropriate for most purposes.

The total number of ring discs 46 used in the two filter assemblies may vary from 10 to as many as 100 depending on the product being processed and the results desired.

The rotor separator agitator disc 18A is constructed with a central opening 57, the outer periphery of which is radially spaced from the shaft extension 50. The rotor separator agitator disc 18B is constructed with a central opening 58, the periphery of which also is radially spaced from shaft extension 50. Discs 18A, 18B and 18C are herein referred to as rotor separator agitator discs because they are shown as being diametrically coextensive with the agitator discs 18 shown throughout the mill as seen in FIG. 1. It should be noted, however, that for purposes of functioning solely as a part of or housing for the filter assemblies 42 and 44, any or all of the discs 18A, 18B and 18C could be designed to a smaller diameter sufficient only to support the ring discs. Accordingly, the term "rotor separator agitator disc" when referring to discs 18A, 18B and 18C is to include these varying diameters.

The inner peripheries of the stacked ring discs 46 of filter assemblies 42 and 44 form with the shaft extension 50 a chamber 60. During the mixing process, product is forced upwardly under pressure through the mill and radially inwardly through spaces 56 between discs 46 of filter assemblies 42 and 44, into chamber 60 and then upwardly along shaft extension 50, through central openings 58 and 57 and into outlet chamber 62 and to outlet 64.

While the rotor separator disclosed herein has been described in association with a vertical shot mill such as described in the above referred to patents, it should be noted that it is also intended to be used with horizontal shot mills which are well known in the art.

The rotor separator as herein disclosed is a substantial improvement over and provides many advantages over devices of the prior art. The number of filter assemblies may be varied from mill to mill. The number of ring discs in each filter assembly may be varied. The spacing between the ring discs of any installation may be varied by simply installing washer-like spacers of different thicknesses. Depending on the viscosity, rheology and solids content or particle size the spacers can be changed, and/or the number of ring discs in the filter assemblies increased or decreased to suit the desired fineness of filtration or internal shot mill chamber pressure. In addition, the filter assemblies are substantially more durable than prior art structures. In that connection, a very important feature is the longer wear capability of the ring discs. The ring discs, for example, can be used until wear reduces the outside diameter of the ring discs to a point where it approaches the bolt holes in the discs. It has been determined, for example, that this substantial wear distance—from O.D. to bolt hole—provides a wear area on the order of 10 times greater than is available with the wedge or vee wire design as disclosed in the above referred to patents.

The overall operation of this apparatus should be apparent from the above description and is substantially as described in the above referred to patents.

While a certain preferred embodiment of the invention has been disclosed, it will be appreciated that this is shown by way of example only, and the invention is not to be limited thereto as other variations will be apparent to those skilled in the art and the invention is to be given its fullest possible interpretation within the terms of the following claims.

What is claimed is:

1. Apparatus for deagglomerating and dispersing particles held in agglomerated form and carried in suspension in a liquid vehicle by the action of a dispersing media on the solids comprising:

a mixing vessel having a fluid inlet at one end thereof and a fluid outlet at the other end thereof, said vessel being adapted to have a charge of dispersing media introduced thereinto, and said inlet being adapted to be operatively connected to a pump means whereby a fluid mixture may be moved by said pump means under pressure through said inlet and through the dispersing media in said vessel to said fluid outlet;

a rotatable agitator shaft extending into said vessel and adapted to be driven from a power source;

a rotor separator mounted on said shaft for rotation therewith for separating dispersing media from the fluid mixture, said rotor separator being disposed on said shaft near said fluid outlet and in the path of flow between said vessel inlet and said outlet, said rotor separator including one or more filter assembly means surrounding and spaced from said shaft, each of said filter assembly means comprising:

(1) a pair of axially spaced rotor separator agitator discs surrounding said agitator shaft;

(2) a plurality of stacked ring discs surrounding said shaft and disposed between and secured to said rotor separator agitator discs;

(3) interchangeable spacer means disposed between adjacent ring discs to provide a predetermined spacing therebetween; and (4) securing means for securing said ring discs between said agitator discs in a predetermined position.

2. The device of claim 1 wherein said means for securing said ring discs between said rotor separator agitator discs includes a plurality of bolts extending through said ring discs and attaching said ring discs to said agitator discs.

3. The device of claim 1 wherein said spacer means comprises a plurality of washer-like elements.

4. The device of claim 3 wherein said spacer means are mounted on said bolts.

5. The device of claim 3 wherein said means for securing said ring discs between said rotor separator agitator discs includes a plurality of bolts extending through said rotor separator agitator discs, said ring discs and said washer-like spacer means.

6. The device of claim 1 wherein said spacer means range from 0.010–0.030 inches in thickness.

7. The device of claim 1 wherein at least one of said rotor separator agitator discs is secured to the agitator shaft.

8. The device of claim 1 including means defining a chamber between the inner diameter of said ring discs and said agitator shaft for receiving processed product after it passes through said ring discs.

9. The device of claim 1 wherein said spacer means are disposed between adjacent discs to provide paths of flow radially inwardly through said stacked ring discs for material being processed.

10. The device of claim 1 wherein said rotor separator includes two filter assemblies attached to each other and axially aligned with each other along the agitator shaft.

11. The device of claim 1 wherein said rotor separator includes a plurality of filter assemblies attached to each other along the agitator shaft, the lowermost of said rotor separator agitator discs being secured to said agitator shaft.

* * * * *